US011082781B2

(12) United States Patent
Kuipers

(10) Patent No.: US 11,082,781 B2
(45) Date of Patent: Aug. 3, 2021

(54) EAR PIECE WITH ACTIVE VENT CONTROL

(71) Applicant: Sonova AG, Stafa (CH)

(72) Inventor: Erwin Kuipers, Wolfhausen (CH)

(73) Assignee: SONOVA AG, Stäfa (CH)

( * ) Notice: Subject to any disclaimer, the term of this patent is extended or adjusted under 35 U.S.C. 154(b) by 112 days.

(21) Appl. No.: 16/535,240

(22) Filed: Aug. 8, 2019

(65) Prior Publication Data

US 2021/0044910 A1 Feb. 11, 2021

(51) Int. Cl.
*H04R 25/00* (2006.01)

(52) U.S. Cl.
CPC ..... *H04R 25/603* (2019.05); *H04R 25/554* (2013.01); *H04R 25/652* (2013.01); *H04R 2225/021* (2013.01); *H04R 2225/41* (2013.01); *H04R 2460/11* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,987,146 | A | 11/1999 | Pluvinage | |
| 6,549,635 | B1 * | 4/2003 | Gebert | H04R 25/456 381/324 |
| 7,609,842 | B2 | 10/2009 | Sipkema | |
| 9,491,554 | B2 * | 11/2016 | Sundberg | H01Q 1/2291 |
| 9,706,313 | B2 * | 7/2017 | Burger | H04R 25/453 |

FOREIGN PATENT DOCUMENTS

| | | | |
|---|---|---|---|
| DE | 19942707 | A1 | 3/2001 |
| DE | 10 2005 006 404 | B3 | 8/2006 |
| WO | 2010/034337 | A1 | 4/2010 |

* cited by examiner

*Primary Examiner* — Amir H Etesam
(74) *Attorney, Agent, or Firm* — Pearne & Gordon LLP

(57) ABSTRACT

A hearing device includes a behind-the-ear (BTE) component with a speaker, an earpiece with an active vent, and a sound tube operatively connecting the earpiece and the speaker of the BTE component. The hearing device further includes a controller that adjusts the configuration of the active vent. The controller can adjust the configuration of the active vent by control signals transmitted via conductive wires, electrically conductive layers, or via a wireless link.

18 Claims, 3 Drawing Sheets

EAR PIECE WITH ACTIVE VENT CONTROL

FIELD OF INVENTION

The following description relates generally to a hearing device and a method for operating a hearing device. More specifically, the following description relates to a hearing device with an active vent and method for an active vent valve control.

BACKGROUND OF INVENTION

Behind-the-ear (BTE) hearing devices include a piece ("earpiece") placed in the ear canal, which is used for holding sound conduction tube(s) and/or other elements. Earpieces, such as the ones used in BTE hearing devices, are acoustically passive elements. They do not have active or controllable elements that can be applied to influence an acoustic function (acoustic coupling). Although a closed coupling is preferable in some use situations, an open coupling is desired in other use situations (own-voice, environmental awareness). With a vent valve, active venting strategies can be possible. However, earpieces usually do not have their own source of electrical power and/or a way to transmit and receive control signals.

SUMMARY

The present invention provides a hearing device that includes an active vent with a vent valve. Specifically, the present invention proposes solutions to implement an active vent for earpieces by applying control signals for the valve control and by employing an electrical power source within the earpiece.

In one general aspect, a hearing device may include a behind-the-ear (BTE) component with a speaker, an earpiece with an active vent, and a sound tube operatively connecting the earpiece and the speaker of the BTE component. The hearing device may include a controller configured to adjust a configuration of the active vent.

In the hearing device according to the foregoing aspect, the controller may be disposed in the BTE component and the sound tube may be configured to transmit an electrical control signal of the controller to the active vent.

In the hearing device according to the foregoing aspect, the sound tube may be configured as a bi-directional channel enabling bi-directional communications between the earpiece and the BTE component.

In the hearing device according to the foregoing aspect, the controller may be configured to control the active vent based on the acoustic environment of the hearing device.

In the hearing device according to the foregoing aspect, the active vent may comprise a vent adjustment mechanism that may be configured to adjust a configuration of the active vent.

In the hearing device according to the foregoing aspect, the vent adjustment mechanism may be a manual actuator.

In the hearing device according to the foregoing aspect, the vent adjustment mechanism may be a vent valve.

In the hearing device according to the foregoing aspect, the earpiece may comprise an earmold and an insert that houses the active vent, the vent valve, and an interface to the sound tube. The earmold may be configured to receive the insert.

In the hearing device according to the foregoing aspect, the insert may comprise an interface to the earmold.

In the hearing device according to the foregoing aspect, the controller may be disposed in the BTE component, the earpiece may comprise earpiece conductors, and the sound tube may comprise sound tube conductors. The earpiece conductors may be configured to be connected to the sound tube conductors to operatively connect the active vent to the controller through the sound tube.

In the hearing device according to the foregoing aspect, the sound tube conductors may comprise conductive wires extending substantially along a length of the sound tube.

In the hearing device according to the foregoing aspect, the earpiece may comprises a sound tube receptacle configured to accommodate the sound tube, the earpiece conductors may comprise electrically conductive layers applied to an inner wall of the sound tube receptacle, and the sound tube conductors may comprise electrically conductive layers applied to an external portion of the sound tube.

In the hearing device according to the foregoing aspect, the BTE component may comprise a power source and the earpiece may receive power from the power source via the sound tube.

In the hearing device according to the foregoing aspect, the BTE component may comprise a wireless transceiver and may be configured to transmit and receive control signals between the BTE component and the earpiece.

In the hearing device according to the foregoing aspect, the controller may be configured to adjust the configuration of the active vent by a control signal transmitted via a wireless link.

In the hearing device according to the foregoing aspect, the wireless link may be configured as a bi-directional channel enabling bi-directional communications between the earpiece and the BTE component.

In the hearing device according to the foregoing aspect, the earpiece may further comprise an earpiece power source and a wireless receiver configured to receive the control signal via the wireless link.

In the hearing device according to the foregoing aspect, the wireless link may be configured to transmit information about at least one of a power state of the earpiece power source, malfunctioning of equipment within the earpiece, or acoustic feedback instabilities from the earpiece to the BTE component.

In another general aspect, a hearing system may include a behind-the-ear (BTE) component with a speaker and a processor, an earpiece with means for adjusting a vent, and a sound tube operatively connecting the earpiece and the speaker of the BTE component. The processor may be operatively connected to, and configured to operate, the means for adjusting the vent based on an acoustic environment of the hearing device.

In another general aspect, a method for operating a hearing device including a behind-the-ear (BTE) component with a speaker and a processor, an earpiece with an active vent, and a sound tube operatively connecting the earpiece and the speaker, wherein the sound tube may be configured to transmit electrical control signals between the processor and the active vent, may include determining an acoustic environment of the hearing device and adjusting a configuration of the active vent based on the acoustic environment of the hearing device.

Other features and aspects may be apparent from the following detailed description, the drawings, and the claims.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
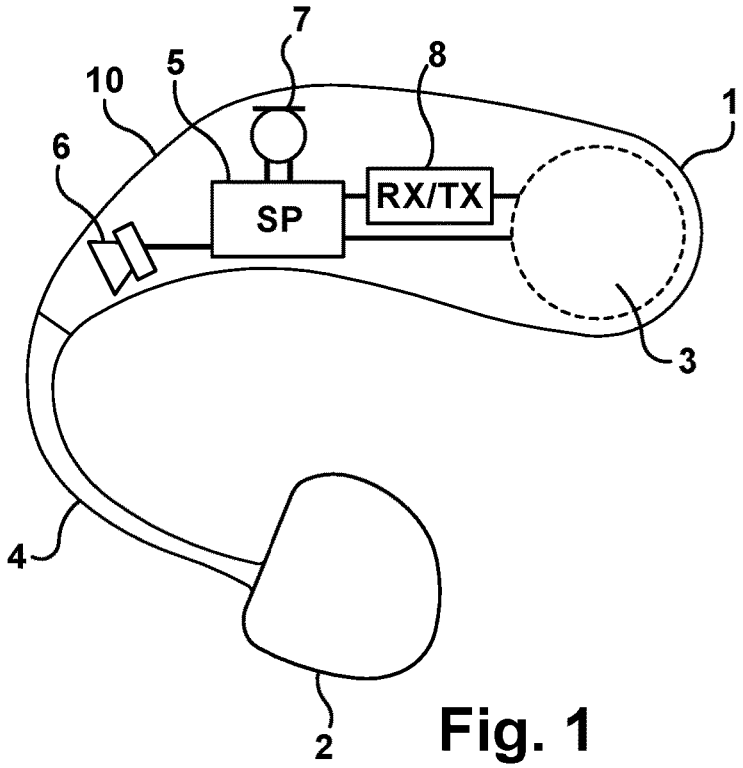
FIG. 1 is a schematic diagram illustrating a hearing device with a behind-the-ear (BTE) component and an earpiece, according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation.

Within the context of the following description, hearing devices (such as hearing aids, hearing prostheses, cochlear implants, earphones, etc.) are specifically utilized by individuals to hear audio from another device or from the user's surroundings and may be used, for example in order to compensate hearing loss and/or improve hearing ability. A pair of hearing devices, one intended to be worn at the left and the other at the right ear of the user, which are linked to one another is referred to as a binaural hearing system. Different styles of hearing devices exist in the form of behind-the-ear (BTE), in-the-ear (ITE), completely-in-canal (CIC) types, as well as hybrid designs consisting of an outside-the-ear part and an in-the-ear part, the latter typically including a receiver (i.e., a miniature loudspeaker), therefore commonly termed receiver-in-the-ear (RITE), receiver-in-canal (RIC), or canal-receiver-technology (CRT) hearing devices. Depending on the severity and/or cause of the user's hearing loss, other electromechanical output transducers, such as a bone-anchored vibrator, a direct acoustic cochlear simulator (DACS) or cochlear implant (CI) can be employed instead of a receiver. Other uses of hearing devices pertain to augmenting the hearing of normal hearing persons, for instance by means of noise suppression, to the provision of audio signals originating from remote sources, e.g., within the context of audio communication, and for hearing protection.

ITE, and especially ITC and CIC hearing devices, are less visible than BTE hearing devices and are therefore preferred by many users. However, in these devices the space in the ear canal has to be used efficiently, and the ear canal essentially has to be closed by the device to minimize acoustic feedback due to the proximity of the sound outlet of the receiver and the sound inlet of the microphone. The closing of the ear canal may cause undesirable effects, such as discomfort from an altered perception of the wearer's own voice due to blocking the ear canal by the hearing device, known as occlusion effect. The occlusion effect may also occur when BTE hearing devices are used because BTE hearing devices include a piece ("earpiece") placed in the ear canal, which is used for holding sound conduction tube(s) and/or other elements.

In order to reduce the occlusion effect, in-the-ear-canal components may include a "vent" or a duct formed through the in-the-ear-canal component. Hearing devices with large vents are popular because the open fitting is perceived as very comfortable by the user. One of the reasons for this popularity is that the occlusion effect is greatly reduced, and the wearer's own voice is perceived more naturally. However, the size of the vent is limited by the ear canal size. In addition, large vents have disadvantages. For example, strong direct sound through the vent, which may not be controlled by the hearing device, may interfere with the sound produced by the hearing device receiver. ITE, ITC, and CIC hearing devices also tend to be exposed to undesirable feedback because the sound produced by the hearing device proceeds through the vent back to the microphone without substantial attenuation. Further, the space used up by the vent can reduce the space in the in-the-ear-canal component, which can interfere with the placement of the receiver and/or other components in the in-the-ear-canal component. Reducing the size of the vent, on the other hand, can diminish the performance of the hearing device because a hearing care professional ("HCP") usually tries to find the optimal balance between hearing and audiological performance on the one hand, and the occlusion effect and the ventilation of the ear canal on the other hand. This perceived balance always results in a compromise because each separate aspect is tuned to far-from optimal or sub-optimal parameters. In practice, the HCPs try to define the vent based on their own experience or based on a recommendation given by the fitting software. The key is to find a balance between the user's perception of the occlusion effect on the one side and acoustic coupling that is appropriate for the user's hearing loss on the other side. This balance, however, may not always consider different acoustic environments. Accordingly, it may be desirable to provide a way of active adjustment of the vent, depending on the acoustic environment.

With a vent valve, such active venting strategies may be possible. However, because earpieces usually do not have their own source of electrical power and/or a way to transmit and receive control signals, BTE users cannot benefit from an active vent control due the lack of electrical power in the earpiece and due the lack of ways to transmit and receive control signals between the earpiece and the BTE component.

The present invention provides a hearing device that includes an active vent with a vent valve. Specifically, the present invention proposes solutions to implement an active vent for earpieces by applying control signals to control the position or status of the vent valve.

FIG. 1 illustrates a hearing device with a behind-the-ear (BTE) component 1 and an in-the-ear (ITE) component, such as an earpiece 2, for example. The earpiece 2 can be a molded earpiece (e.g., earmold), for example. The illustrated BTE component 1 can include a housing 10, a battery 3, a signal processor 5, a speaker 6 (also known as a "receiver"), and a microphone 7. The housing 10 of the BTE component 1 can be shaped as a behind-the-ear hearing aid hook configured to cover the outside of a user's ear. The BTE component 1 can be connected to the earpiece 2 via a sound tube 4, for example. Sound generated by the speaker 6 can be transmitted to the earpiece 2 from the upper end of the sound tube 4. The sound tube 4 can be initially provided with an excess length, such as three inches, for example, which can be trimmed later to an appropriate length for a particular user.

The microphone 7 of the BTE component 1 can be configured to capture an audio signal and convert the audio signal into an electrical input signal. The microphone 7 may be a system including more than one microphone. The microphone 7 may be directional, i.e., may pick up most sounds in front a person wearing the microphone, or omni-directional, i.e., may pick up sounds from all directions. In addition to the microphone 7, the BTE component 1 may include additional means for receiving signals, such as a telecoil receiver, a receiving unit including an antenna for receiving wirelessly transmitted signals, etc. For example, the BTE component 1 may receive a streamed audio input signal (such as a phone call or music) from a streaming input source by a wired or wireless connection.

The signal processor 5 of the BTE component 1 can be configured to receive electrical input signals obtained from the microphone 7 and convert these electrical input signals into digital signals that can be processed further to obtain an electrical output signal. A desired electrical input signal can be the electrical input signal obtained by the microphone 7, the streamed audio input signal, or a mix of both input signals. The electrical output signal can be converted into an acoustic output signal and can be emitted into the remaining volume between the user's eardrum 2' and the earpiece 2 of the hearing device.

The signal processor 5 may be a single digital signal processor or may be made up of different, potentially distributed processor units, preferably including at least one digital signal processor unit. The signal processor 5 can include one or more of a microprocessor, a microcontroller, a digital signal processor (DSP), an application specific integrated circuit (ASIC), a field-programmable gate array (FPGA), discrete logic circuitry, or the like. The signal processor 5 may be adapted to differentiate sounds, such as speech and background noise, and process the sounds differently for a seamless hearing experience. The signal processor 5 can further support cancellation of feedback or noise from wind, ambient disturbances, etc.

The BTE component 1 can be configured to wirelessly receive audio or other signals from the earpiece 2 or from another device, component or system, such as a remote hearing device controller, a mobile phone, a hearing loop system, an audio link device, or a streaming device, for example. The BTE component 1 can include a wireless communication unit 8, such as a transceiver configured to receive and optionally to transmit wireless signals to other devices. For example, the BTE component 1 may receive wireless audio signals and/or control signals from a remote device and to convey them to the signal processor 5 or other part of the BTE component 1 and/or the earpiece 2. The BTE transceiver 8 may also be configured to transmit wireless audio signals and/or control signals from the signal processor 5 or other part of the hearing device to the earpiece 2 and/or to a remote device. Alternatively, the BTE transceiver 8 may be configured as a transmitter only or as a receiver only. In certain embodiments, the BTE transceiver 8 may be a part of the signal processor 5.

The signal processor 5 can further include memory (not shown in FIG. 1) and may store tables with predetermined values, ranges, and thresholds, as well as program instructions that may cause the signal processor 5 to access the memory, execute the program instructions, and provide the functionality ascribed to it herein. The memory may include one or more volatile, non-volatile, magnetic, optical, or electrical media, such as read-only memory (ROM), random access memory (RAM), electrically-erasable programmable ROM (EEPROM), flash memory, or the like. The signal processor 5 can further include one or more analog-to-digital (A/D) and digital-to-analog (D/A) converters for converting various analog inputs to the signal processor 5, such as analog input from the microphone 7, for example, in digital signals and for converting various digital outputs from the signal processor 5 to analog signals representing audible sound data which can be applied to the speaker 6, for example.

Figure 2:
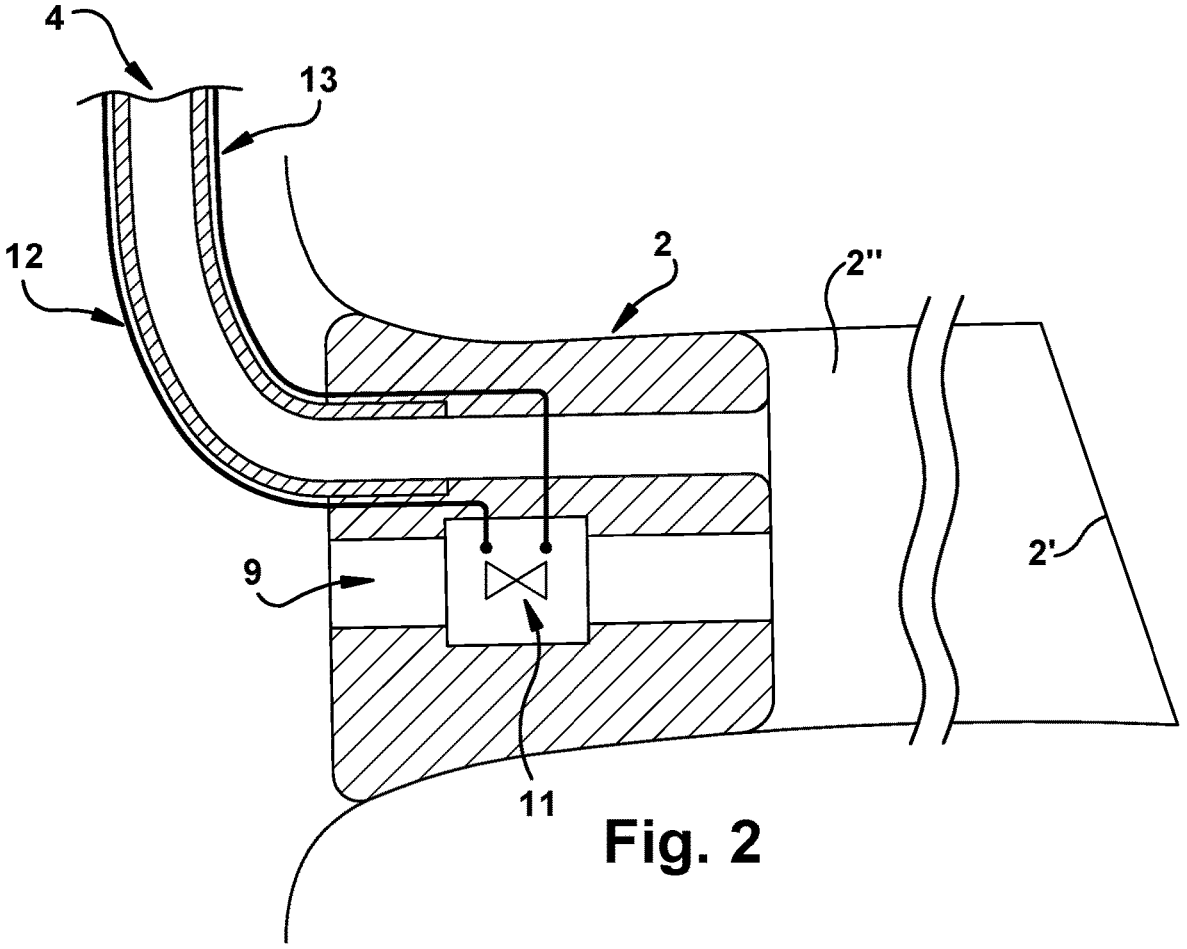
FIG. 2 is a schematic diagram illustrating an earpiece with an active vent.

FIG. 2 shows a schematic design of an earpiece 2 inserted into an ear canal 2". The earpiece 2 can include a vent 9 that may be formed between the remaining volume between the user's eardrum 2' and the earpiece 2, and the surrounding atmosphere. The vent 9 may be a duct or a passage of the earpiece 2 or it may be formed by space between a side of the device and the ear canal 2" itself in the case of an open fitting.

The vent 9 may be configured as an active vent, which means that an acoustic characteristic of the vent 9 may be adjusted. The adjustment of the vent 9 may be based on the acoustic environment. For example, the vent 9 may be switched on or off between a fully opened configuration (in quiet environments), a fully closed configuration (when a loud noise is perceived, when streaming music, or in the event of power loss as a fail-safe operation), or may be placed in an intermediate configuration between the fully opened configuration and the fully closed configuration.

The vent 9 may be adjusted manually by the user or automatically by means for adjusting the vent or a vent adjustment mechanism, such as an electrically controlled vent valve 11, for example. The vent valve 11 may be used to control the acoustic coupling of the hearing device with the ear canal 2". The vent valve 11 can be an electrically actuated vent valve, an electromagnetic valve, an electrostatic valve, a mechanical valve, or a valve employing any other actuation technology.

The operation or adjustment of the vent valve 11 may be controlled by electrical control signals transmitted, for example, by the signal processor 5 arranged in the BTE component 1 to the vent valve 11. The electrical control signals transmitted by the signal processor 5 to the vent valve 11 can be in response to changes in the acoustic environment of the hearing device. Changes in the acoustic environment of the hearing device may be detected by a differential pressure sensor 14 (shown in FIGS. 3A and 3B), for example. The differential pressure sensor 14 can detect the difference between the ambient (e.g., external to the earpiece 2) air pressure $P_{Amb}$ and the pressure in the user's ear $P_{EC}$. Electrical signal carrying information about the detected differential pressure can be transmitted by the differential pressure sensor 14 to the signal processor 5, where the detected differential pressure can be compared to a threshold amount. In response to the electrical signal from the differential pressure sensor 14, if the signal processor 5 determines that the pressure changes in the user's ear may be uncomfortable or painful for the user, the signal processor 5 can transmit an electrical signal to the valve 11 or to a valve actuating mechanism to adjust the open/close state of the valve 11 in order to assist with isolating the user's ear pressure from the ambient pressure changes.

Figure 3A:
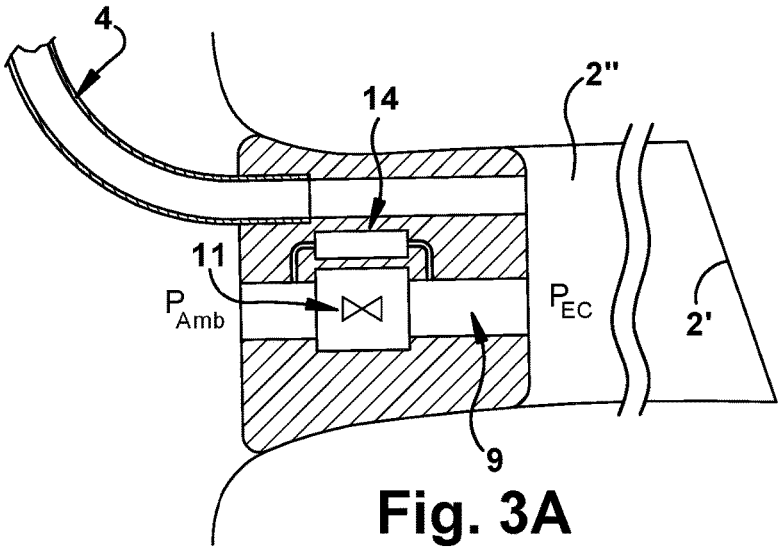
FIG. 3A is a schematic diagram illustrating an earpiece with a differential pressure sensor and an active vent, according to an embodiment.
Figure 3B:
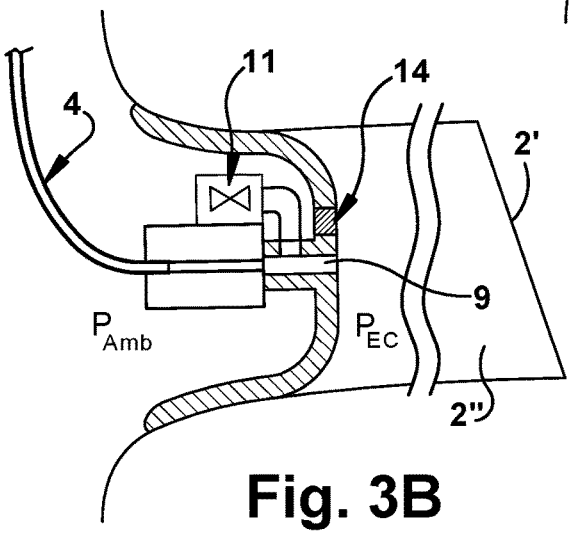
FIG. 3B is a schematic diagram illustrating an earpiece with a differential pressure sensor, according to an embodiment.

As shown in FIGS. 3A and 3B, the differential pressure sensor 14 can be integrated in different ways. For example, the differential pressure sensor 14 illustrated in FIG. 3A can be connected parallel to the valve 11.

Alternatively, as shown in FIG. 3B, the differential pressure sensor 14 can be arranged to face the ear canal 2" within or at the outside of the earpiece 2 shell.

However, embodiments for detecting changes in the acoustic environment of the hearing device are not limited to a differential pressure sensor, and other methods may be utilized. For example, the acoustic environment of the hearing device may be detected with an acoustic environment classifier that detects the acoustic environment of the hearing system and classifies the acoustic environment as one of one or more predetermined acoustic environment types stored in a memory, as described in U.S. Pat. No. 9,491,556, for example. The acoustic environment may also be determined by an audio analyzer (being or comprising a sound classifier) based on the input audio signal. Other methods for detecting the acoustic environment of the hearing device known to those skilled in the art may also be utilized.

In certain embodiments, the operation or adjustment of the vent valve 11 may be controlled based on control signals received from temperature or humidity sensors, as well as from optical or photonic sensors configured for detecting physiological data.

Turning back to FIG. 2, the electrical signal from the signal processor 5 to the vent valve 11 may be transmitted through conductors 12 and/or 13 that may be integrated with the sound tube 4, for example. The conductors 12 and 13 may be configured for bidirectional communication through the sound tube 4 between the signal processor 5 of the BTE component 1 and the vent valve 11.

In one embodiment, the conductors 12 and 13 may be provided as conductive wires applied to an outer wall of the sound tube 4. For example, electrically conductive material for the conductive wires 12 and 13 may be printed along the outer wall of the sound tube 4 extending substantially along the entire length of the sound tube 4. For example, the sound tube 4 may be formed by additive manufacturing, whereby additional material may be printed on the outer surface of the sound tube 4. In certain embodiments, conductive layers for the conductors 12 and 13 may be applied as a spray on the outer wall of the sound tube 4. However, embodiments are not limited thereto and other configurations are possible. For example, conductive layers for the conductors 12 and 13 may be embedded (by in-molding) during the tube extrusion process. Galvanic separation between the conductive layers for the conductors 12 and 13 can be realized by using different angular orientations of the conductive layers, for example.

Alternatively, conductive wires for the conductors 12 and 13 may be guided through the volume of the sound tube 4, in a manner similar to the manufacturing of a vent tube, for example. Other embodiments can include wires, conductive layers on the inside of the sound tube 4, tubes made of electrically conducting material, a coaxially layered tube, etc.

Figure 4A:
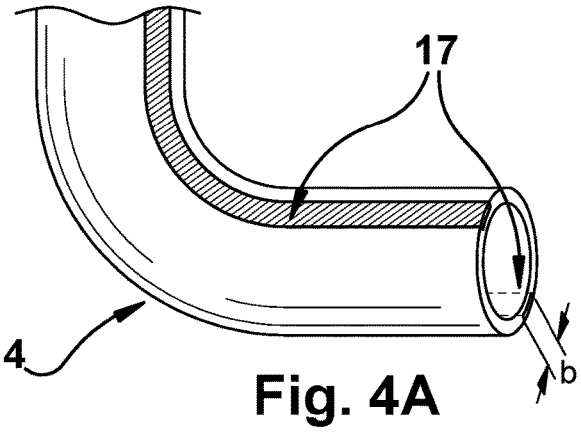
FIG. 4A is a schematic diagram illustrating electrically conductive layers applied to the sound tube.
Figure 4C:
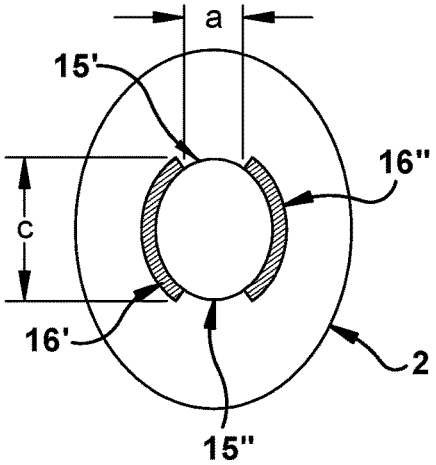
FIG. 4C is a cross-sectional view of the electrically conductive layers applied to the earpiece shown in FIG. 4B.
Figure 4B:
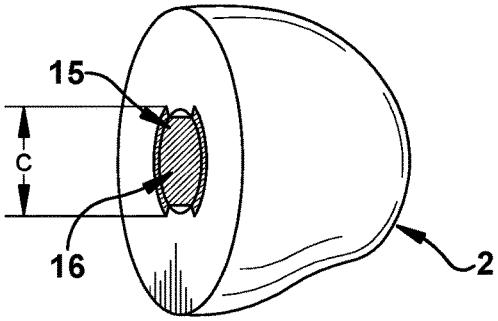
FIG. 4B is a schematic diagram illustrating electrically conductive layers applied to the earpiece.

In certain embodiments, the earpiece 2 may include a sound tube receptacle (or bore) 15 (shown in FIG. 4B). The sound tube receptacle 15 may be configured to tightly accommodate the sound tube 4 to ensure a tight connection between the sound tube 4 and the sound tube receptacle 15 within the earpiece 2. In this configuration, both the earpiece 2 and the sound tube 4 may include electrically conductive layers 16 and 17, respectively (as shown in FIGS. 4A and 4B). As illustrated in FIG. 4A, two electrically conductive layers 17 may be provided on the outer wall of the sound tube 4. Although only one electrically conductive layer 16 is illustrated in FIG. 4B (due to the side view of the earpiece 2), two electrically conductive layers 16 corresponding to the two electrically conductive layers 17 on the outer wall of the sound tube 4 may be provided on the inner wall of the sound tube receptacle 15 within the earpiece 2. The electrically conductive layers 16 and 17 may be configured to operatively connect the earpiece 2 to the BTE component 1 through the sound tube 4. For example, the electrically conductive layers 16 and 17 may be used to transmit an electrical signal from the signal processor 5 arranged in the BTE component 1 to the vent valve 11 arranged in the earpiece 2 and to adjust the vent valve 11 in response to the acoustic environment of the hearing device.

FIG. 4C is a cross-sectional view of the electrically conductive layers 16 applied to the inner wall of the sound tube receptacle 15 within the earpiece 2 (one of which is shown in FIG. 4B). Each of the two electrically conductive layers 16' and 16" may have a cross-sectional width "c" that may be configured to match the width "b" of the electrically conductive layers 17 on the outer wall of the sound tube 4 (shown in FIG. 4A) or the width "c" may be greater than the width "b" to ensure a good electrical contact even if there is a slight misalignment of the earpiece 2 relative to the sound tube 4. The two electrically conductive layers 16' and 16" may be separated by non-conductive portions 15' and 15" of the sound tube receptacle 15. The two non-conductive portions 15' and 15" of the sound tube receptacle 15 may be configured with a cross-sectional width "a" that may be larger than the cross-sectional width "b" of the two electrically conductive layers 17 to avoid short-circuiting the two electrically conductive layers 17 on the sound tube 4.

Figure 5:
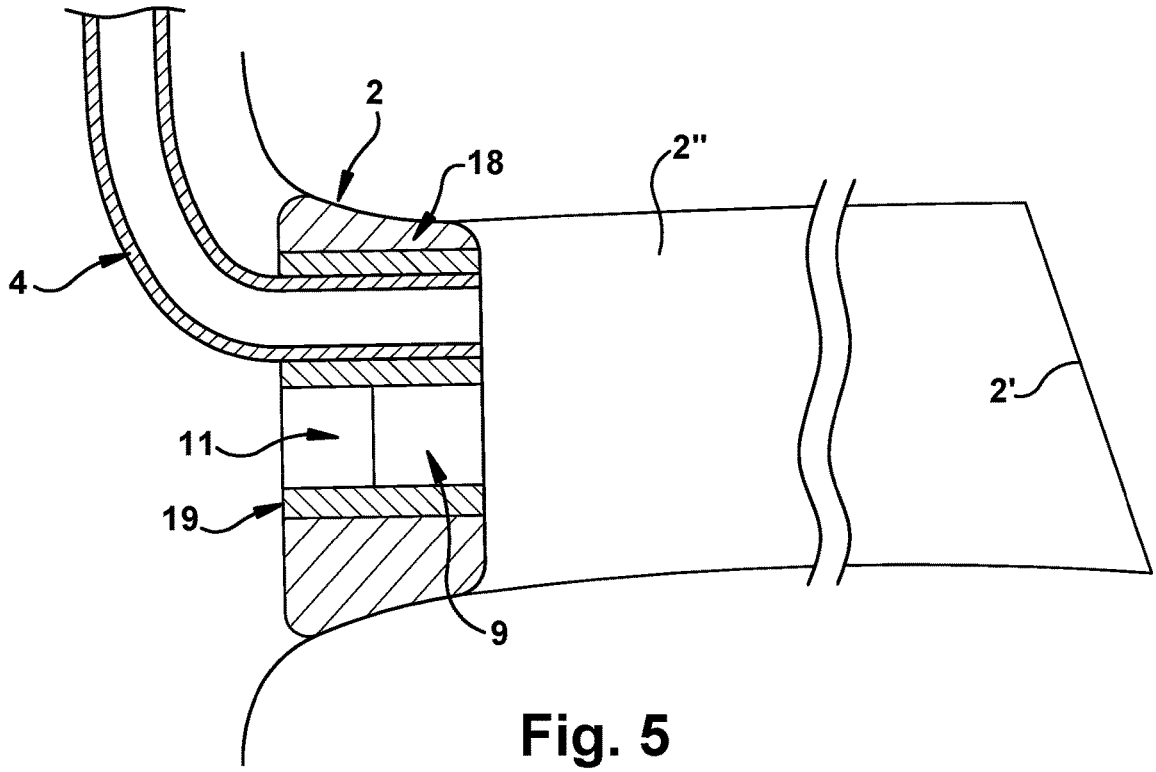
FIG. 5 is a schematic diagram illustrating an earpiece with a modular insert and an active vent.

In one embodiment illustrated in FIG. 5, the earpiece 2 may include an earmold 18 and a premanufactured modular insert 19. The earmold 18 can be configured to receive the modular insert 19 via a connecting interface, for example. The modular insert 19 may be configured to house the active vent 9, the vent valve 11, and a connecting interface to the sound tube 4. In certain embodiments, the insert 19 may house acoustic filters and/or wax filters, for example. During fabrication of the earpiece 2, the earmold 18 may be casted or 3D-printed, and space for the modular insert 19 can be foreseen, for instance by CAD-modeling (e.g., custom earpiece modeling software). According to conventional techniques for making custom shells, ear molds, ear pieces, and the like, a user-specific ear canal geometry can be first determined. This may include taking an ear impression and then 3D-scanning the impression. A 3D model of the impression may then be created by in part detailing where the shape of the final shell is fit into an dataset of the 3D-scan of the impression (e.g., with a 3D-modeling software). The custom shell can be then manufactured, for example by additive manufacturing techniques. Finally, the device may be assembled. Typically, custom shells have a lateral opening on which a faceplate or accessory is attached to cover the lateral opening. Electronic components of the hearing device can be attached to the faceplate/module and/or provided inside an inner volume enclosed by the housing. For example, a printed circuit board (PCB) including the electronic components can be provided inside the inner volume. Thus, the final assembly can include inserting the electronic components into an inner volume of the shell and covering a lateral opening of the shell with the faceplate attached to the shell.

With the modular insert 19, the earpiece 2 itself can be reduced to an anatomical element for the purposes of acoustic insulation, retention, and wearing comfort. As a result, there may be lower risk of damaging sensitive electromechanical components during the assembly of the earpiece 2. In certain embodiments, the duct forming the vent 9 may be merged with the sound tube 4 to save space and to lower the acoustic vent mass.

The connecting interface between the modular insert 19 and the earmold 18 may include docking connectors, ridges, pins, cams, rails, locking tabs or locking fingers, screws, etc. For servicing, the modular insert 19 can be removed from the earmold 18 by non-destructive methods, such as unlocking the tabs or locking fingers, removing the pins, loosening the screws, etc.

Figure 6:
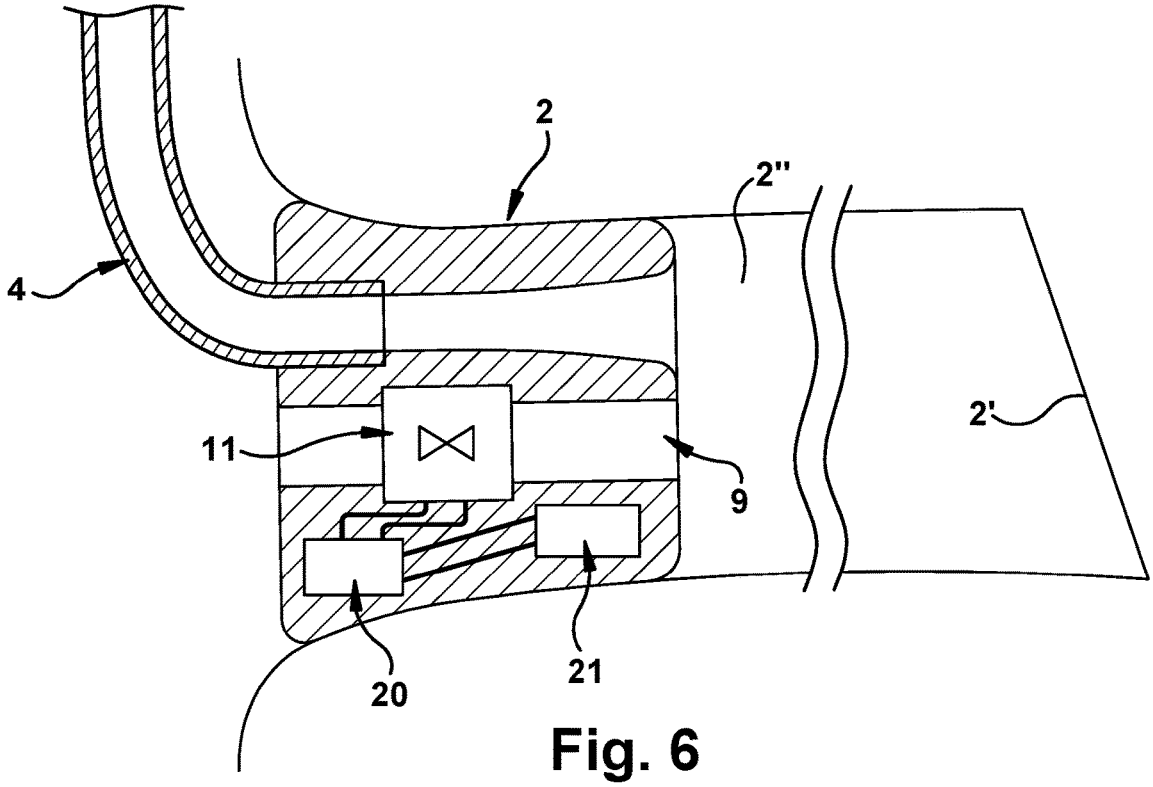
FIG. 6 is a schematic diagram illustrating a hearing device with a behind-the-ear (BTE) component and an earpiece configured for wireless communication, according to an embodiment.

Another embodiment of the earpiece 2 is illustrated in FIG. 6. This embodiment can employ an electrical power source within the earpiece and wireless communication between the BTE component 1 and the earpiece 2. Specifically, the communication between the earpiece 2 and the BTE component 1 can be performed through wireless links using wireless communication protocols, such as Bluetooth or Wi-Fi® (based on the IEEE 802.11 family of standards of the Institute of Electrical and Electronics Engineers), or the like, as well as radio frequency (RF) communication protocols, for example. The BTE component 1 can include a signal processor 5 and a wireless transceiver (TX/RX) 8 (shown in FIG. 1). The earpiece 2 can include a sending/receiving element (RX/TX) 20 that can be configured as a wireless interface to the BTE component 1 (shown in FIG. 1). The sending/receiving element (RX/TX) 20 can be a wireless receiver configured to receive wireless signals transmitted from the BTE component 1 to the earpiece 2. For example, wireless signals transmitted from the BTE component 1 to the earpiece 2 can be control signals for adjusting the state or position of the valve 11. The sending/receiving element (RX/TX) 20 can be a wireless receiver only. However, the sending/receiving element (RX/TX) 20 does not necessarily exclude a transmission function.

In certain embodiments, the sending/receiving element (RX/TX) 20 in the earpiece 2 can be a wireless transceiver configured to receive wireless signals transmitted from the BTE component 1, and optionally to transmit wireless signals from the earpiece 2 to the BTE component 1 and to convey them to the signal processor 5 or other part of the BTE component 1. Example wireless signals transmitted from the earpiece 2 to the BTE component 1 can be signals carrying information related to acoustic feedback instabilities in the earpiece, malfunctioning of equipment within the earpiece, and the state of the earpiece power source (as described below).

A separate power source (e.g., battery) 21 can be arranged in the earpiece 2. The earpiece battery 21 may be rechargeable or may be located in a battery compartment in the earpiece 2 such that straightforward replacement can be possible. Power from the earpiece battery 21 can be supplied to the wireless (RX/TX) signal unit 20 and the valve 11, for example. The wireless (RX/TX) signal unit 20 can be configured to process wireless signals related to the state of the earpiece battery 21, for example, and/or to transmit energy from the battery 3 of the BTE component 1 necessary to charge the earpiece battery 21 in response to these signals. Since the distance between the earpiece 2 and the controlling instrument (i.e., the BTE component 1) is typically in the range of a few centimeters and the transmitted data rate is relatively low, not much electrical power will be required for this kind of wireless operation. As a result, the earpiece battery 21 can be selected with a relatively small size.

The possibility of transmitting wireless signals between the earpiece 2 and the BTE component 1 can enable useful information, such as state of the earpiece battery 21, status, or malfunctioning of any equipment within the earpiece 2, to be transmitted and presented to the user of the hearing device.

In addition, the earpiece 2 may be able to utilize additional components, such as sensors for monitoring pulse oximetry, heart-rate, blood pressure, canal microphones, accelerometers/gyroscopes, GPS receivers, etc. Such additional components and/or sensors are usually incorporated in the BTE component because BTE components offer more space than RICs or ITEs, and because earpieces may not have an integrated processor to process inputs from these components and/or sensors. However, it may be possible to arrange some of these components and/or sensors in the earpiece component and transmit data related to measurements by these components and/or sensors to the BTE component 1 through the integrated conductive layers or wires in the sound tube 4. These sensors may be arranged on the outside of the earpiece 2, for example. For example, the earpiece 2 may include a light source and a photodetector configured to collect photoplethysmogram (PPG) data. The light source may be used to illuminate tissue inside the ear canal 2" and the photodetector may be configured to detect the reflected light at the earpiece 2. Based on the detected light, it may be possible to determine changes in light absorption caused by the blood flowing through the tissue during a heartbeat sequence. The collected PPG data can be used by a processor in the BTE component 1 to determine physiological data, such as heartrate, blood pressure, blood oxygen levels, blood analyte levels, breathing rate or volume, and the like. Because the distance between the earpiece 2 and the controlling instrument (i.e., the BTE component 1) is typically in the range of a few centimeters and the transmitted data rate is relatively low, not much electrical power would be required in the earpiece 2 for this kind of wireless operation.

BTE users can benefit from several advantages offered by the active vent described above. For example, the active vent may be closed in response to acoustic feedback instabilities. The active vent solution may also allow improved ear canal ventilation. For example, the vent may be kept open if no usable signals are detected. The active vent solution may also achieve improved sound quality for music and other signals with significant low-frequency components. The active vent solution may further provide improved speech intelligibility due to beamforming and noise cancelling as entry of direct sound can be eliminated.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be desirable to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A hearing device comprising:

a behind-the-ear (BTE) component with a speaker;

an earpiece with an active vent;

a sound tube operatively connecting the earpiece and the speaker of the BTE component; and a controller configured to adjust a configuration of the active vent, wherein the sound tube is configured to transmit an electrical control signal of the controller to the active vent, and wherein the sound tube is configured as a bi-directional channel enabling bi-directional communications between the earpiece and the BTE component.

2. The hearing device according to claim 1, wherein the controller is disposed in the BTE component.

3. The hearing device according to claim 1, wherein the controller is configured to control the active vent based on an acoustic environment of the hearing device.

4. The hearing device according to claim 1, wherein the active vent comprises a vent adjustment mechanism configured to adjust the configuration of the active vent.

5. The hearing device according to claim 4, wherein the vent adjustment mechanism is a manual actuator.

6. The hearing device according to claim 4, wherein the vent adjustment mechanism is a vent valve.

7. The hearing device according to claim 6, wherein the earpiece comprises an earmold and an insert that houses the active vent, the vent valve, and an interface to the sound tube, wherein the earmold is configured to receive the insert.

8. The hearing device according to claim 7, wherein the insert comprises an interface to the earmold.

9. The hearing device according to claim 1, wherein the controller is disposed in the BTE component, the earpiece comprises earpiece conductors, the sound tube comprises sound tube conductors, and the earpiece conductors are configured to be connected to the sound tube conductors to operatively connect the active vent to the controller through the sound tube.

10. The hearing device according to claim 9, wherein the sound tube conductors comprise conductive wires extending substantially along a length of the sound tube.

11. The hearing device according to claim 9, wherein the earpiece comprises a sound tube receptacle configured to accommodate the sound tube, the earpiece conductors comprise electrically conductive layers applied to an inner wall of the sound tube receptacle, and the sound tube conductors comprise electrically conductive layers applied to an external portion of the sound tube.

12. The hearing device according to claim 1, wherein the BTE component comprises a power source and the earpiece receives power from the power source via the sound tube.

13. The hearing device according to claim 1, wherein the BTE component comprises a wireless transceiver configured to transmit and receive control signals between the BTE component and the earpiece.

14. A hearing device comprising:

a behind-the-ear (BTE) component with a speaker;

an earpiece with an active vent a sound tube operatively connecting the earpiece and the speaker of the BTE component and a controller configured to adjust a configuration of the active vent, wherein the controller is configured to adjust the configuration of the active vent by a control signal transmitted via a wireless link, and wherein the wireless link is configured as a bi-directional channel enabling bi-directional communications between the earpiece and the BTE component.

15. The hearing device according to claim 14, wherein the earpiece further comprises an earpiece power source and a wireless receiver configured to receive the control signal via the wireless link.

16. The hearing device according to claim 15, wherein the wireless link is configured to transmit information about at least one of a power state of the earpiece power source, malfunctioning of equipment within the earpiece, or acoustic feedback instabilities from the earpiece to the BTE component.

17. A hearing system comprising:

a behind-the-ear (BTE) component with a speaker and a processor;

an earpiece with means for adjusting a vent; and a sound tube operatively connecting the earpiece and the speaker of the BTE component, wherein the processor is operatively connected to, and configured to operate, the means for adjusting the vent based on an acoustic environment of the hearing device, wherein the sound tube is configured to transmit an electrical control signal of the controller to the active vent, and wherein the sound tube is configured as a bi-directional channel enabling bi-directional communications between the earpiece and the BTE component.

18. A method for operating a hearing device including a behind-the-ear (BTE) component with a speaker and a processor, an earpiece with an active vent, and a sound tube operatively connecting the earpiece and the speaker, wherein the sound tube is configured to transmit electrical control signals between the processor and the active vent, the method comprising:

determining an acoustic environment of the hearing device;

establishing bi-directional communications between the earpiece and the BTE component via a bi-directional channel; and adjusting a configuration of the active vent based on the acoustic environment of the hearing device by transmitting an electrical control signal of the controller to the active vent via the sound tube.

* * * * *